US009527190B2

(12) United States Patent
Woody

(10) Patent No.: US 9,527,190 B2
(45) Date of Patent: Dec. 27, 2016

(54) HIGH ARTICULATION GLOVE WITH REMOVABLE WORK SURFACE ATTACHMENTS

(71) Applicant: Fredrick Woody, The Woodlands, TX (US)

(72) Inventor: Fredrick Woody, The Woodlands, TX (US)

( * ) Notice: Subject to any disclaimer, the term of this patent is extended or adjusted under 35 U.S.C. 154(b) by 0 days.

(21) Appl. No.: 14/252,838

(22) Filed: Apr. 15, 2014

(65) Prior Publication Data

US 2015/0289576 A1 Oct. 15, 2015

(51) Int. Cl.

| | |
|---|---|
| ***B24D 15/04*** | (2006.01) |
| ***A41D 19/00*** | (2006.01) |
| ***A47L 13/18*** | (2006.01) |
| ***A41D 19/015*** | (2006.01) |

(52) U.S. Cl.

CPC ..... *B24D 15/045* (2013.01); *A41D 19/0024* (2013.01); *A41D 19/01552* (2013.01); *A47L 13/18* (2013.01)

(58) Field of Classification Search

CPC ..... A41D 19/01588; A41D 19/0024; A41D 19/01594

USPC ..... 2/16, 20, 161.1, 161.6, 163, 161.2, 0.3; 15/227, 229.11; 294/25; 473/205

See application file for complete search history.

(56) References Cited

U.S. PATENT DOCUMENTS

| | | | | |
|---|---|---|---|---|
| 3,789,555 | A | 2/1974 | Means | |
| 4,038,787 | A | 8/1977 | Bianchi | |
| 4,621,388 | A | 11/1986 | Ortolivo | |
| 4,980,943 | A | 1/1991 | Barber | |
| 5,195,745 | A * | 3/1993 | Rudell | A63B 43/005 124/79 |
| 5,316,294 | A * | 5/1994 | Turangan | A63B 43/005 2/159 |
| 5,885,148 | A | 3/1999 | Vargas et al. | |
| 6,000,060 | A | 12/1999 | Borucki-Mastej | |
| 6,016,571 | A * | 1/2000 | Guzman et al. | 2/167 |
| 6,098,234 | A * | 8/2000 | Jackson, Jr. | 15/118 |
| 6,557,178 | B1 * | 5/2003 | Hoover | A41D 19/01594 15/227 |
| 6,575,822 | B2 | 6/2003 | Lowe et al. | |
| 6,604,244 | B1 | 8/2003 | Leach | |
| 7,823,245 | B2 | 11/2010 | Firouzman | |
| 7,874,020 | B1 * | 1/2011 | Franklin | 2/160 |
| 8,062,101 | B1 | 11/2011 | Friend | |
| 8,356,378 | B1 | 1/2013 | Crooms | |
| 2002/0009966 | A1 | 1/2002 | Orr | |
| 2004/0063390 | A1 | 4/2004 | Codd | |

(Continued)

FOREIGN PATENT DOCUMENTS

| | | |
|---|---|---|
| GB | 2260889 A | 5/1993 |
| GB | 2368776 A | 5/2002 |

*Primary Examiner* — Katherine Moran

(74) *Attorney, Agent, or Firm* — Basil M. Angelo; Angelo Mikeska PLLC

(57) ABSTRACT

A high articulation glove includes a covering for a human hand. The covering includes a palm portion, a dorsal portion, a thumb sheath, an index finger sheath, a middle finger sheath, a ring finger sheath, and a small finger sheath. At least one hook or loop fastener is attached to a distal phalanx portion of at least one of the finger sheaths on a palm side of the covering. The at least one hook or loop fastener has a size smaller than the distal phalanx portion of the corresponding at least one finger sheath on the palm side of the covering it is attached to.

14 Claims, 9 Drawing Sheets

(56) References Cited

U.S. PATENT DOCUMENTS

| | | | | |
|---|---|---|---|---|
| 2005/0060786 | A1 | 3/2005 | Ran | |
| 2005/0097654 | A1 | 5/2005 | Ran | |
| 2007/0234466 | A1* | 10/2007 | Stengel | 2/160 |
| 2013/0227760 | A1* | 9/2013 | Mahon | 2/160 |

* cited by examiner

HIGH ARTICULATION GLOVE WITH REMOVABLE WORK SURFACE ATTACHMENTS

BACKGROUND OF THE INVENTION

The human hand includes fourteen phalanges, five metacarpal bones, and eight carpal bones. The fourteen phalanges form the bony structure of the fingers and the thumb. The index finger, middle finger, ring finger, and small finger each include a proximal phalanx bone, an intermediate phalanx bone, and a distal phalanx bone and the thumb includes a proximal phalanx bone and a distal phalanx bone. With respect to the fingers, distal interphalangeal joints are formed between the distal phalanges and the corresponding intermediate phalanges and proximal interphalangeal joints are formed between the intermediate phalanges and the corresponding proximal phalanges. Metacarpophalangeal joints are formed between the proximal phalanges of the fingers and the corresponding metacarpal bones. With respect to the thumb, a distal interphalangeal joint is formed between the distal phalanx bone and the corresponding proximal phalanx bone. A metacarpophalangeal joint is formed between the proximal phalanx bone of the thumb and the corresponding metacarpal bone.

The interphalangeal joints and the metacarpophalangeal joints articulate, somewhat independently of one another, and the carpal bones allow for intercarpal articulation of the wrist. Each finger is capable of bending independently of one another towards the palm of the hand. The thumb is opposable such that it may be brought to meet one or more of the fingers. Bony arches of the hand, such as longitudinal arches formed by the phalanges and their corresponding metacarpal bones, transverse arches formed by the carpal bones and distal ends of the metacarpal bones, and oblique arches formed by the thumb and the fingers, allow for the fingers and the palm of the hand to curve around objects. As a consequence, the human hand is a precise instrument capable of a diverse range of motions and poses, including the ability to grasp one or more objects with varying degrees of pressure.

BRIEF SUMMARY OF THE INVENTION

According to one aspect of one or more embodiments of the present invention, a high articulation glove includes a covering for a human hand. The covering includes a palm portion, a dorsal portion, a thumb sheath, an index finger sheath, a middle finger sheath, a ring finger sheath, and a small finger sheath. At least one hook or loop fastener is attached to a distal phalanx portion of at least one of the finger sheaths on a palm side of the covering. The at least one hook or loop fastener has a size smaller than the distal phalanx portion of the corresponding at least one finger sheath on the palm side of the covering it is attached to.

Other aspects of the present invention will be apparent from the following description and claims.

DETAILED DESCRIPTION OF THE INVENTION

Figure 1:
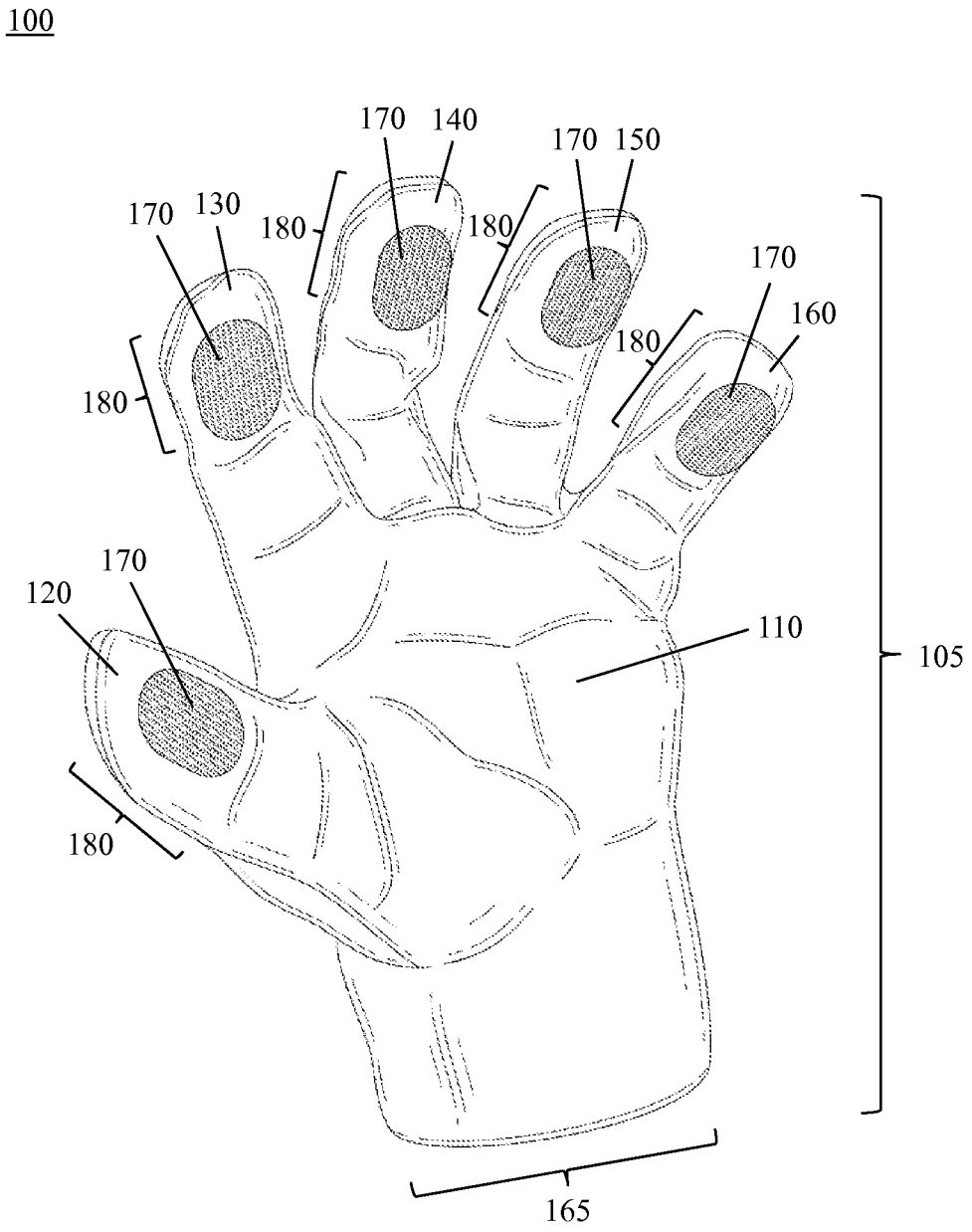
FIG. 1 shows a palm side perspective view of a high articulation glove in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

The human hand is prone to epidermal injury when exposed to extreme temperatures, certain types of radiation, various chemicals or compounds, rough surfaces, or sharp protrusions that potentially cause contusions, abrasions, or lacerations. The hand is also prone to musculoskeletal injury when exposed to excessive force or bones or joints are extended beyond their intended range of motion. If the forces exerted on the hand are extreme, skeletal injury can result including the fracture or dislocation of one or more bones or joints. Because the human hand is one of, if not the, most important tools we use in our daily lives, it is important to protect the hand from injury at all times.

Gloves are typically used in an attempt to protect the hand from injury while working or performing other tasks that require the use of the hands. Gloves are commonly used in industrial applications, commercial applications, consumer applications, sports, and in the performance of household chores. However, in various applications, such as, for example, woodworking, a number of different types of gloves may be used to perform a task or series of tasks. When performing tasks that require more protection for the hand, a semi-rigid or rigid work glove may be used. A conventional semi-rigid or rigid work glove typically includes a thick base material with additional padding or additional material, sometimes of a different type, disposed on a palm portion, a dorsal portion, and the finger portions of the glove to protect the soft tissue of the hand and strengthen the glove. However, the rigidity of the glove may restrict the ability of the gloved hand to articulate fully, compromise fundamental grip, and fatigue the hand when gripping an object for an extended period of time. In addition, the bulkiness of the glove may prevent the use of certain tools and may not fit in constrained spaces. As such, the worker may change or remove the glove.

When performing tasks that require improved grip, a gripping glove may be used. A conventional gripping glove typically includes a gripping material in a palm portion of the glove to improve grip when grasping objects. While the ability of the gloved hand to grip may be improved, the gripping material may restrict the ability of the gloved hand to articulate fully, reduce the tactile feel of the hand, and fatigue the hand when gripping an object for an extended period of time. As such, the worker may change or remove the glove. When performing tasks that require dexterous use of the hands, such as, for example, tasks that require the worker to articulate the hand through the full range of hand motion, perform precise tasks with the hand, or feel the surface they are working with, the worker may elect to not wear a glove and allow his hand to articulate freely, potentially exposing the hand to injury. As a consequence, it is not uncommon for a worker to use a number of different types of gloves as well as the ungloved hand in the performance of their work, putting on and taking off one or more gloves as needed for a given task or series of tasks. The putting on and taking off of the gloves over the course of the performance of work reduces efficiency, compromises the safety of the worker, and potentially exposes the hand to injury. In addition, the act of putting on and taking off the glove can be cumbersome.

In one or more embodiments of the present invention, a high articulation glove may be used in the performance of a task or series of tasks without requiring the putting on or taking off of the glove or the use of multiple gloves. The multi-purpose high articulation glove compliments the precision of the hand and the diversity of hand movement in a manner than does not inhibit the range of motion over a conventional glove made of the same material and maximizes control of the gloved hand, including ergonomic grip. The high articulation glove allows for the ergonomic use of one or more removable work surface attachments that promote natural motion of the gloved hand and/or the gloved fingers without requiring constant grip that would otherwise be required. In one or more embodiments of the present invention, a high articulation glove protects the gloved hand and allows for the dexterous use of the gloved hand while working on or with one or more objects including one or more surfaces, angles, and/or corners. The distal and the proximal interphalangeal joints, the metacarpophalangeal joints, and the bony arches of the hand may articulate such that the glove may be worn continuously throughout the performance of work.

FIG. 1 shows a palm side perspective view of a high articulation glove 100 in accordance with one or more embodiments of the present invention. High articulation glove 100 includes a covering 105 for a human hand (not independently illustrated) that includes a palm portion 110, a dorsal portion (not shown), a thumb sheath 120, an index finger sheath 130, a middle finger sheath 140, a ring finger sheath 150, and a small finger sheath 160. Covering 105 forms a hand sheath configured to receive the hand through a distal opening in a wrist area 165 and covers the entire hand in an anatomically correct manner. In certain embodiments, covering 105 may be a seamless and unibody hand sheath. In other embodiments, covering 105 may be a sheath formed out of a plurality of distinct material sections attached to one another. One of ordinary skill in the art will recognize that covering 105 may vary based on an application or design in accordance with one or more embodiments of the present invention.

In certain embodiments, covering 105 may be comprised of leather. In other embodiments, covering 105 may be comprised of fabric. In still other embodiments, covering 105 may be comprised of latex. In still other embodiments, covering 105 may be comprised of rubber, nitrile, plastic material, elastomeric material, or combinations thereof. In still other embodiments, where covering 105 includes a sheath formed out of a plurality of distinct material sections, different material sections may be formed of different materials. One of ordinary skill in the art will recognize that the composition of covering 105 may vary based on an application or design in accordance with one or more embodiments of the present invention. In certain embodiments, covering 105 may be flexible. In other embodiments, covering 105 may be semi-rigid. In still other embodiments, covering 105 may be rigid. One of ordinary skill in the art will recognize that the flexibility or the rigidity of covering 105 may vary based on an application or design in accordance with one or more embodiments of the present invention. The size of covering 105 may vary to accommodate hands of differing size. The fit of covering 105 may vary based on an application or design.

In certain embodiments, at least one hook or loop fastener 170 may be attached to a distal phalanx portion 180 of at least one of finger sheaths 130, 140, 150, or 160 on a palm side of covering 105. In other embodiments, at least one hook or loop fastener 170 may be integrated into a distal phalanx portion 180 of at least one of finger sheaths 130, 140, 150, or 160 on the palm side of covering 105. A conventional hook and loop fastening system includes a hook fastener and a loop fastener that, when joined together, form a strong bond. The strength of the bond depends on the size of the area of contact between the hook fastener and the loop fastener and the pressure applied in joining them together. In certain embodiments, the at least one hook or loop fastener 170 may be a hook fastener. In other embodiments, the at least one hook or loop fastener 170 may be a loop fastener. In still other embodiments, where the at least one hook or loop fastener 170 comprises more than one hook or loop fastener 170, a combination of hook fasteners and loop fasteners may be used.

The number of hook or loop fasteners 170 disposed on the palm side of covering 105 may vary based on an application or design. In certain embodiments, a single hook or loop fastener 170 may be used on a single finger sheath on the palm side of covering 105. The hook or loop fastener 170 may be attached to a distal phalanx portion 180 of one of index finger sheath 130, middle finger sheath 140, ring finger sheath 150, or small finger sheath 160 on the palm side of covering 105.

In other embodiments, two hook or loop fasteners 170 may be used on two finger sheaths on the palm side of covering 105. A first hook or loop fastener 170 may be attached to a distal phalanx portion 180 of one of index finger sheath 130, middle finger sheath 140, ring finger sheath 150, or small finger sheath 160 on the palm side of covering 105. A second hook or loop fastener 170 may be attached to a distal phalanx portion 180 of a different finger sheath than the first hook or loop fastener 170, on the palm side of covering 105.

In still other embodiments, three hook or loop fasteners 170 may be used on three finger sheaths on the palm side of covering 105. A first hook or loop fastener 170 may be attached to a distal phalanx portion 180 of one of index finger sheath 130, middle finger sheath 140, ring finger sheath 150, or small finger sheath 160 on the palm side of covering 105. A second hook or loop fastener 170 may be attached to a distal phalanx portion 180 of a different finger sheath than the first hook or loop fastener 170, on the palm side of glove 100. A third hook or loop fastener 170 may be attached to a distal phalanx portion 180 of a different finger sheath than the first hook or loop fastener 170 and the second hook or loop fastener 170, on the palm side of covering 105.

In still other embodiments, four hook or loop fasteners 170 may be used on all finger sheaths on the palm side of covering 105. A first hook or loop fastener 170 may be attached to a distal phalanx portion 180 of index finger sheath 130 on the palm side of covering 105. A second hook or loop fastener 170 may be attached to a distal phalanx portion 180 of middle finger sheath 140 on the palm side of covering 105. A third hook or loop fastener 170 may be attached to a distal phalanx portion 180 of ring finger sheath 150 on the palm side of covering 105. A fourth hook or loop fastener 170 may be attached to distal phalanx portion 180 of small finger sheath 160 on the palm side of covering 105.

In certain embodiments, a hook or loop fastener 170 may optionally be attached to a distal phalanx portion 180 of thumb sheath 120 on the palm side of covering 105. In other embodiments, there is no hook or loop fastener 170 attached to thumb sheath 120 on the palm side of covering 105.

In certain embodiments, the at least one hook or loop fasteners 170 may be attached to the palm side of covering 105 by an adhesive. In other embodiments, the at least one hook or loop fasteners 170 may be attached to the palm side of covering 105 by stitching. In still other embodiments, the at least one hook or loop fasteners 170 may be integrated into the palm side of covering 105 during fabrication of covering 105. One of ordinary skill in the art will recognize that other means of attachment are within the scope of one or more embodiments of the present invention.

In certain embodiments, one or more removable work surface attachments (not shown) may be removably attached to one or more of the hook or loop fasteners 170 disposed on, or integrated into, the palm side of glove 100. Each removable work surface attachment may include a complimentary loop or hook fastener (not shown) disposed on a first side and a work surface (not shown) disposed on a second side.

Each of the at least one hook or loop fasteners 170 on the palm side of covering 105 are constrained to a size smaller than the distal phalanx portion 180 of the corresponding at least one finger sheaths on the palm side of covering 105. This size provides a sufficiently strong bond to attach a removable work surface attachment (not shown), but also allows easy removal without having to take off glove 100.

An intermediate phalanx portion of finger sheaths 130, 140, 150, and 160 and a proximal phalanx portion of thumb 120 are free from encumbrance by hook or loop fasteners. There are no hook or loop fasteners 170 attached to the intermediate phalanx portions of finger sheaths 130, 140, 150, and 160 on the palm side of covering 105 and there is no hook or loop fastener 170 attached to the proximal phalanx portion of thumb sheath 120 on the palm side of covering 105. As such, the distal interphalangeal joints of the fingers and the thumb of the hand can articulate while wearing glove 100. A proximal phalanx portion of finger sheaths 130, 140, 150, and 160 are free from encumbrance by hook or loop fasteners. There are no hook or loop fasteners 170 attached to the proximal phalanx portions of finger sheaths 130, 140, 150, and 160 on the palm side of covering 105. As such, the proximal interphalangeal joint of the fingers of the hand can articulate while wearing glove 100. A metacarpal portion of palm portion 110 of covering 105 is free from encumbrance by hook or loop fasteners. There are no hook or loop fasteners 170 attached to palm portion 110 of covering 105. As such, the metacarpophalangeal joints of the hand as well as the bony arches of the hand can articulate while wearing glove 100. In addition, the thumb articulates such that it may be brought to meet one or more of the fingers. As such, the gloved hand may articulate allowing the palm of the hand to curve around objects. In this way, a plurality of distal interphalangeal joints, a plurality of proximal interphalangeal joints, a plurality of metacarpophalangeal joints, and a plurality of bony arches of the hand can articulate while wearing high articulation glove 100.

In certain embodiments, the gloved hand may articulate through the same range of hand motion as a conventional glove composed of the same material. The attachment of the at least one hook or loop fasteners 170 to a distal phalanx portion 180 of at least one of finger sheaths 130, 140, 150, or 160 on the palm side of covering 105 does not inhibit articulation or range of motion.

Figure 2:
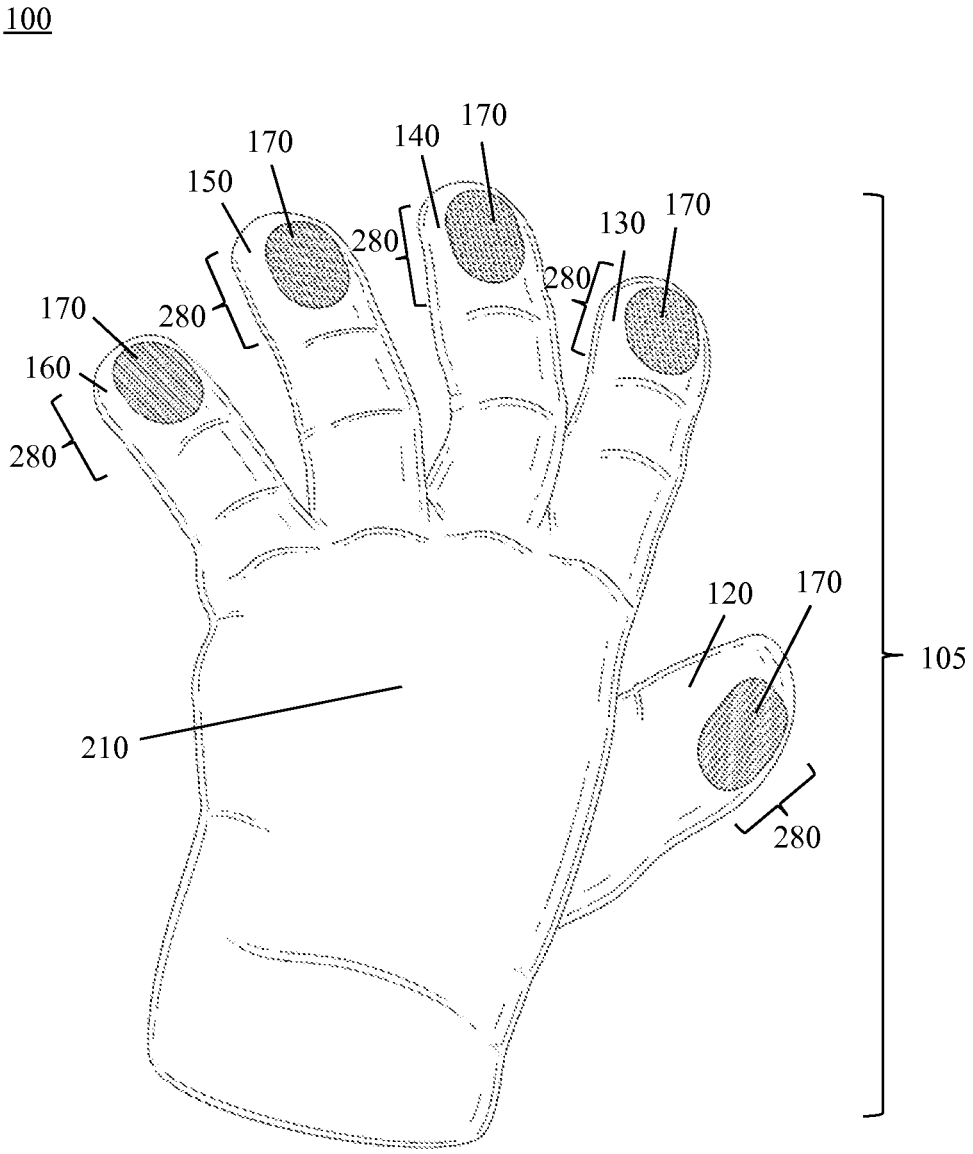
FIG. 2 shows a dorsal side perspective view of a high articulation glove in accordance with one or more embodiments of the present invention.

FIG. 2 shows a dorsal side perspective view of a high articulation glove 100 in accordance with one or more embodiments of the present invention. In certain embodiments, there are no hook or loop fasteners 170 attached to the dorsal side of covering 105. In other embodiments, at least one hook or loop fastener 170 may be attached to a distal phalanx portion 280 of at least one of finger sheaths 130, 140, 150, or 160 on the dorsal side of covering 105. In certain embodiments, the at least one hook or loop fastener 170 may be a hook fastener. In other embodiments, the at least one hook or loop fastener 170 may be a loop fastener. In still other embodiments, where the at least one hook or loop fastener 170 comprises more than one hook or loop fasteners 170, a combination of hook fasteners and loop fasteners may be used. In still other embodiments, the dorsal side of covering 105 may use a different type of fastener (hook or loop) than used on a palm side of covering 105.

The number of hook or loop fasteners 170 disposed on the dorsal side of covering 105, if any, may vary based on an application or design. In certain embodiments, a single hook or loop fastener 170 may be used on a single finger sheath on the dorsal side of covering 105. The hook or loop fastener 170 may be attached to a distal phalanx portion 280 of one of index finger sheath 130, middle finger sheath 140, ring finger sheath 150, or small finger sheath 160 on the dorsal side of covering 105.

In other embodiments, two hook or loop fasteners 170 may be used on two finger sheaths on the dorsal side of covering 105. A first hook or loop fastener 170 may be attached to a distal phalanx portion 280 of one of index finger sheath 130, middle finger sheath 140, ring finger sheath 150, or small finger sheath 160 on the dorsal side of covering 105. A second hook or loop fastener 170 may be attached to a distal phalanx portion 280 of a different finger sheath than the first hook or loop fastener 170, on the dorsal side of covering 105.

In still other embodiments, three hook or loop fasteners 170 may be used on three finger sheaths on the dorsal side of covering 105. A first hook or loop fastener 170 may be attached to a distal phalanx portion 280 of one of index finger sheath 130, middle finger sheath 140, ring finger sheath 150, or small finger sheath 160 on the dorsal side of covering 105. A second hook or loop fastener 170 may be attached to a distal phalanx portion 280 of a different finger sheath than the first hook or loop fastener 170, on the dorsal side of glove 100. A third hook or loop fastener 170 may be attached to a distal phalanx portion 280 of a different finger sheath than the first hook or loop fastener 170 and the second hook or loop fastener 170, on the dorsal side of covering 105.

In still other embodiments, four hook or loop fasteners 170 may be used on all finger sheaths on the dorsal side of covering 105. A first hook or loop fastener 170 may be attached to a distal phalanx portion 280 of index finger sheath 130 on the dorsal side of covering 105. A second hook or loop fastener 170 may be attached to a distal phalanx portion 280 of middle finger sheath 140 on the dorsal side of covering 105. A third hook or loop fastener 170 may be attached to a distal phalanx portion 280 of ring finger sheath 150 on the dorsal side of covering 105. A fourth hook or loop fastener 170 may be attached to distal phalanx portion 280 of small finger sheath 160 on the dorsal side of covering 105.

In certain embodiments, a hook or loop fastener 170 may optionally be attached to a distal phalanx portion 280 of thumb sheath 120 on the dorsal side of covering 105. In other embodiments, there is no hook or loop fastener 170 attached to thumb sheath 120 on the dorsal side of covering 105.

In certain embodiments, the at least one hook or loop fasteners 170 may be attached to the dorsal side of covering 105 by an adhesive. In other embodiments, the at least one hook or loop fasteners 170 may be attached to the dorsal side of covering 105 by stitching. In still other embodiments, the at least one hook or loop fasteners 170 may be integrated into the dorsal side of covering 105 during fabrication of covering 105. One of ordinary skill in the art will recognize that other means of attachment are within the scope of one or more embodiments of the present invention.

In certain embodiments, one or more removable work surface attachments (not shown) may be removably attached to one or more of the hook or loop fasteners 170 disposed on, or integrated into, the dorsal side of glove 100. Each removable work surface attachment may include a complimentary loop or hook fastener (not shown) disposed on a first side and a work surface (not shown) disposed on a second side.

Each of the at least one hook or loop fasteners 170 on the dorsal side of covering 105, if any, are constrained to a size smaller than the distal phalanx portion 280 of the corresponding at least one finger sheaths on the dorsal side of covering 105. This size provides a sufficiently strong bond to attach a removable work surface attachment (not shown), but also allows easy removal without having to take off glove 100.

The intermediate phalanx portion of finger sheaths 130, 140, 150, and 160 and a proximal phalanx portion of thumb 120 are free from encumbrance by hook or loop fasteners. There are no hook or loop fasteners 170 attached to the intermediate phalanx portions of finger sheaths 130, 140, 150, and 160 on the dorsal side of covering 105 and there is no hook or loop fastener 170 attached to the proximal phalanx portion of thumb sheath 120 on the dorsal side of covering 105. As such, the distal interphalangeal joints of the fingers and the thumb of the hand can articulate while wearing glove 100. The proximal phalanx portion of finger sheaths 130, 140, 150, and 160 are free from encumbrance by hook or loop fasteners. There are no hook or loop fasteners 170 attached to the proximal phalanx portions of finger sheaths 130, 140, 150, and 160 on the dorsal side of covering 105. As such, the proximal interphalangeal joint of the fingers of the hand can articulate while wearing glove 100. A metacarpal portion of dorsal portion 210 of covering 105 is free from encumbrance by hook or loop fasteners. There are no hook or loop fasteners 170 to dorsal portion 210 of covering 105. As such, the metacarpophalangeal joints of the hand as well as the bony arches of the hand can articulate while wearing glove 100. In addition, the thumb articulates such that it may be brought to meet one or more of the fingers. As such, the gloved hand may articulate allowing the palm of the hand to curve around objects. In this way, the plurality of distal interphalangeal joints, the plurality of proximal interphalangeal joints, the plurality of metacarpophalangeal joints, and the plurality of bony arches of the hand can articulate while wearing high articulation glove 100.

In certain embodiments, the gloved hand may articulate through the same range of hand motion as a conventional glove composed of the same material. The attachment of the at least one hook or loop fasteners 170 to a distal phalanx portion 180 of at least one of finger sheaths 130, 140, 150, or 160 on the palm side of covering 105 does not inhibit articulation or range of motion. Similarly, in embodiments where there is one or more hook or loop fasteners 170 disposed on the dorsal side of covering 105, the attachment of one or more hook or loop fasteners 170 to a distal phalanx portion 280 of at least one of finger sheaths 130, 140, 150, or 160 on the dorsal side of covering 105 also does not inhibit articulation or range of motion. The palm side and the dorsal side of covering 105 are not encumbered by hook or loop fasteners that inhibit articulation and limit the range of motion of the gloved hand.

Figure 3:
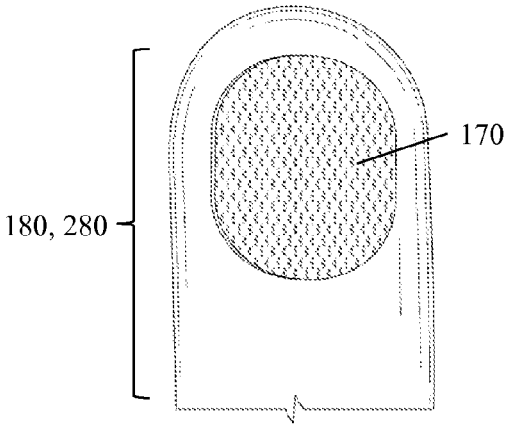
FIG. 3 shows a substantially oval hook fastener disposed on a distal phalanx portion of a finger sheath or a thumb sheath of a high articulation glove in accordance with one or more embodiments of the present invention.

FIG. 3 shows a substantially oval hook fastener 170 disposed on a distal phalanx portion 180 or 280 of one or more of finger sheaths 130, 140, 150, or 160 (illustrated in FIGS. 1 and 2), or thumb sheath 120 (illustrated in FIGS. 1 and 2) of a high articulation glove 100 in accordance with one or more embodiments of the present invention. In certain embodiments, a substantially oval hook or loop fastener 170 may be used on the palm side of covering 105 and/or the dorsal side of covering 105 as discussed previously with respect to FIGS. 1 and 2. The substantially oval hook or loop fastener 170 provides a coverage area of hook or loop that ensures a strong bond to a removable work surface attachment (not shown), but also allows for easy removal. Because the substantially oval shape closely mimics the shape of the distal phalanges of the fingers or thumb of the hand, the tactile feel of the fingers is substantially maintained.

Figure 4:
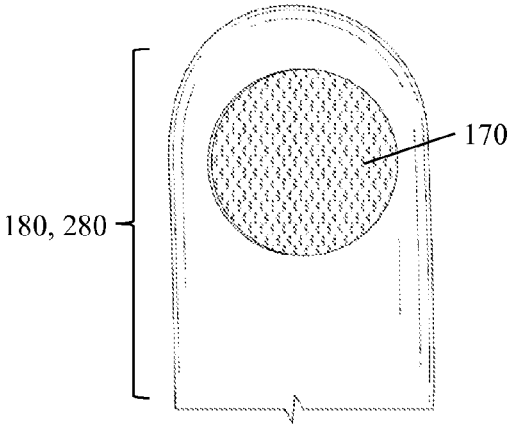
FIG. 4 shows a substantially circular hook fastener disposed on a distal phalanx portion of a finger sheath or a thumb sheath of a high articulation glove in accordance with one or more embodiments of the present invention.

FIG. 4 shows a substantially circular hook fastener 170 disposed on a distal phalanx portion 180 or 280 of one or more of finger sheaths 130, 140, 150, or 160 (illustrated in FIGS. 1 and 2), or thumb sheath 120 (illustrated in FIGS. 1 and 2) of a high articulation glove 100 in accordance with one or more embodiments of the present invention. In certain embodiments, a substantially circular hook or loop fastener 170 may be used on the palm side of covering 105 and/or the dorsal side of covering 105 as discussed previously with respect to FIGS. 1 and 2. The substantially circular shape provides sufficient coverage area of hook or loop to attach a removable work surface attachment (not shown) and minimizes the footprint of hook or loop fastener 170. Because of the reduced footprint, the tactile feel of the fingers may be improved.

Figure 5:
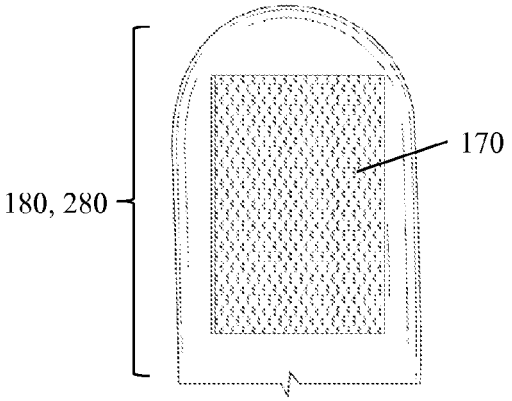
FIG. 5 shows a substantially rectangular hook fastener disposed on a distal phalanx portion of a finger sheath or a thumb sheath of a high articulation glove in accordance with one or more embodiments of the present invention.

FIG. 5 shows a substantially rectangular hook fastener 170 disposed on a distal phalanx portion 180 or 280 of one or more of finger sheaths 130, 140, 150, or 160 (illustrated in FIGS. 1 and 2), or thumb sheath 120 (illustrated in FIGS. 1 and 2) of a high articulation glove 100 in accordance with one or more embodiments of the present invention. In certain embodiments, a substantially rectangular hook or loop fastener 170 may be used on the palm side of covering 105 and/or the dorsal side of covering 105 as discussed previously with respect to FIGS. 1 and 2. The substantially rectangular shape maximizes the coverage area of hook or loop to attach a removable work surface attachment (not shown) and provides the strongest possible bond. However, the substantially rectangular shape maximizes the footprint of hook or loop fastener 170.

Figure 6:
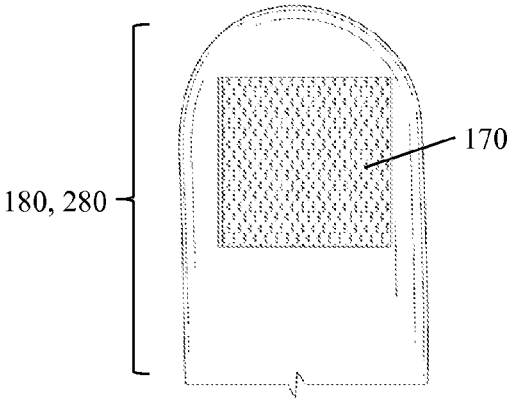
FIG. 6 shows a substantially square hook fastener disposed on a distal phalanx portion of a finger sheath or a thumb sheath of a high articulation glove in accordance with one or more embodiments of the present invention.

FIG. 6 shows a substantially square hook fastener 170 disposed on a distal phalanx portion 180 or 280 of one or more finger sheaths 130, 140, 150, or 160 (illustrated in FIGS. 1 and 2), or thumb sheath 120 (illustrated in FIGS. 1 and 2) of a high articulation glove 100 in accordance with one or more embodiments of the present invention. In certain embodiments, a substantially square hook or loop fastener 170 may be used on the palm side of covering 105 and/or the dorsal side of covering 105 as discussed previously with respect to FIGS. 1 and 2. The substantially square shape provides sufficient coverage area of hook or loop to attach a removable work surface attachment (not shown) and reduces the footprint of hook or loop fastener 170. Because of the reduced footprint, the tactile feel of the fingers may be improved.

A shape or a size of a hook or loop fastener 170 may vary based on a shape or a size of a corresponding loop or hook fastener disposed on a removable work surface attachment. The shape or the size of a hook or loop fastener 170 may also vary with a shape or a size of a removable work surface attachment. One of ordinary skill in the art will recognize that a shape and a size of a hook or loop fastener 170 may vary based on an application or design in accordance with one or more embodiments of the present invention.

Figure 7:
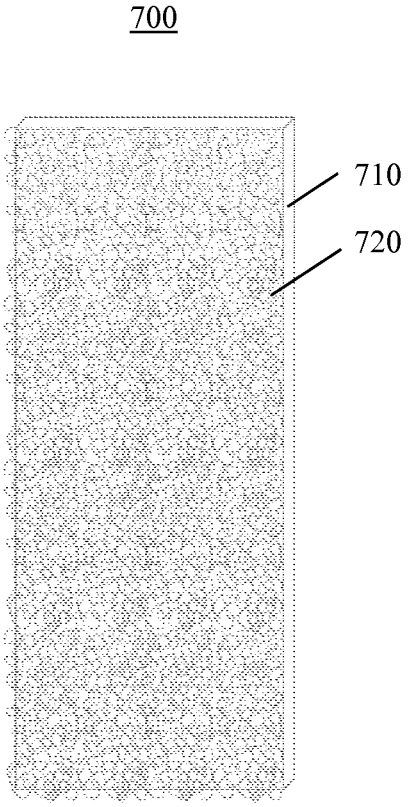
FIG. 7 shows a first side of a removable work surface attachment in accordance with one or more embodiments of the present invention.

FIG. 7 shows a first side of a removable work surface attachment 700 in accordance with one or more embodiments of the present invention. A removable work surface attachment 700 may include a complimentary loop or hook fastener 720 on a first side and a work surface (not shown) on a second side. Loop or hook fastener 720 is capable of fastening to one or more corresponding hook or loop fasteners (e.g., 170 of FIG. 1) attached to, or integrated into, a high articulation glove (e.g., 100 of FIG. 1). In this way, a removable work surface attachment 700 may be removably attached to a gloved hand.

A size of removable work surface attachment 700 may vary based on an application or design. In certain embodiments, removable work surface attachment 700 may have a size that allows the distal interphalangeal joints, the proximal interphalangeal joints, the metacarpophalangeal joints, and the bony arches of the hand to articulate when removable work surface attachment 700 is attached to a high articulation glove (e.g., 100 of FIG. 1). In other embodiments, removable work surface attachment 700 may have a size that allows the proximal interphalangeal joints, the metacarpophalangeal joints, and the bony arches of the hand to articulate when attached to a high articulation glove (e.g., 100 of FIG. 1). In still other embodiments, removable work surface attachment 700 may have a size that allows the metacarpophalangeal joints and the bony arches of the hand to articulate when attached to a high articulation glove (e.g., 100 of FIG. 1). In still other embodiments, removable work surface attachment 700 may have a size that allows the bony arches of the hand to articulate when attached to a high articulation glove (e.g., 100 of FIG. 1).

In certain embodiments, removable work surface attachment 700 may have a size such that a removable work surface attachment 700 may be attached to a single finger sheath of a high articulation glove (e.g., 100 of FIG. 1). In other embodiments, a removable work surface attachment 700 may have a size that spans a plurality of finger sheaths of a high articulation glove (e.g., 100 of FIG. 1). In still other embodiments, removable work surface attachment 700 may have a size such that a plurality of removable work surface attachments 700 may be attached to a plurality of finger sheaths of a high articulation glove (e.g., 100 of FIG. 1). One of ordinary skill in the art will recognize that the size of removable work surface attachment 700 may vary based on an application or design in accordance with one or more embodiments of the present invention.

A shape of removable work surface attachment 700 may vary based on an application or design. In certain embodiments, removable work surface attachment 700 may have a substantially rectangular shape. In other embodiments, removable work surface attachment 700 may have a substantially square shape (not shown). In still other embodiments, removable work surface attachment 700 may have a substantially oval shape (not shown). In still other embodiments, removable work surface attachment 700 may have a substantially circular shape (not shown). In still other embodiments, removable work surface attachment 700 may have sharp or rounded corners (not shown). One of ordinary skill in the art will recognize that the shape of removable work surface attachment 700 may vary based on an application or design in accordance with one or more embodiments of the present invention.

Removable work surface attachment 700 includes a complimentary loop or hook fastener 720 configured to mate with one or more corresponding hook or loop fasteners (e.g., 170 of FIG. 1) attached to, or integrated into, a high articulation glove (e.g., 100 of FIG. 1). In certain embodiments, loop or hook fastener 720 may be attached to a first side of a base member 710. Base member 710 may be used in applications or designs that require some manner of rigidity for the attachment. Base member 710 may be formed of, for example, metal, metal alloys, wood, particleboard, cardboard, plastic, rubber, elastomeric material, fabric, any other natural or synthetic material, or composites of materials discussed herein suitable to provide the desired amount of rigidity. Depending on an application or design, loop or hook fastener 720 may be attached to the first side of base member 710 by an adhesive, stitching, welding, or soldering. In other embodiments, removable work surface attachment 700 may not include a base member 710 and the backside of loop or hook fastener 720 may serve as the point of attachment to a backside of a work surface (not shown). In embodiments that do not include a base member 710, the flexibility of removable work surface attachment 700 may be maximized, improving flexibility and tactile feel. One of ordinary skill in the art will recognize that the composition of removable work surface attachment 700 may vary based on an application or design in accordance with one or more embodiments of the present invention.

Figure 8:
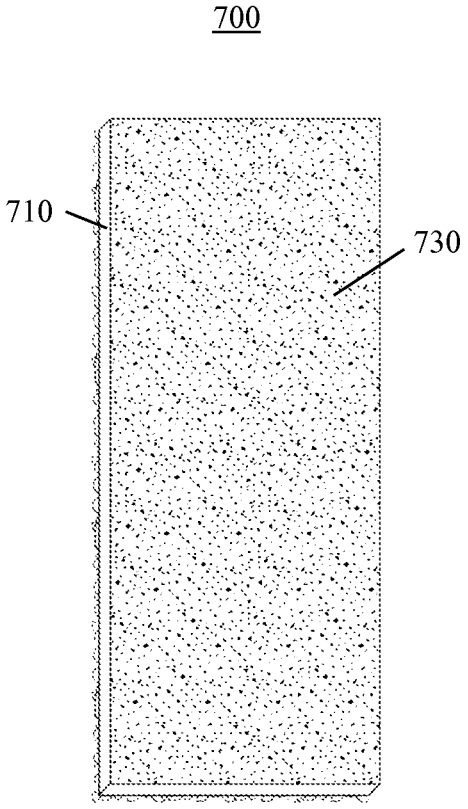
FIG. 8 shows a second side of a removable work surface attachment in accordance with one or more embodiments of the present invention.

FIG. 8 shows a second side of a removable work surface attachment 700 in accordance with one or more embodiments of the present invention. A removable work surface attachment 700 typically includes a loop or hook fastener (e.g., 720 of FIG. 7) and a work surface 730. Work surface 730 may be used to work with various surfaces, angles, and/or corners of an object. In certain embodiments, work surface 730 may comprise a sanding surface. In other embodiments, work surface 730 may comprise a polishing surface. In still other embodiments, work surface 730 may comprise a scouring surface. In still other embodiments, work surface 730 may comprise a cleaning surface. In still other embodiments, work surface 730 may comprise a coated abrasive material. In still other embodiments, work surface 730 may comprise synthetic fiber abrasive mesh. In still other embodiments, work surface 730 may comprise a metal abrasive mesh. In still other embodiments, work surface 730 may comprise cellulose sponge. In still other embodiments, work surface 730 may comprise cloth or fabric. One of ordinary skill in the art will recognize that work surface 730 may vary based on an application or design in accordance with one or more embodiments of the present invention.

In certain embodiments, work surface 730 may be attached to a second side of a base member 710. Base member 710 may be used in applications or designs that require some manner of rigidity for the attachment. Base member 710 may be formed of, for example, metal, metal alloys, wood, particleboard, cardboard, rubber, elastomeric material, fabric, any other natural or synthetic material, or composites of materials discussed herein. Depending on an application or design, work surface 730 may be attached to the second side of base member 710 by an adhesive, stitching, welding, or soldering. In other embodiments, removable work surface attachment 700 may not include a base member 710 and the backside of work surface 730 may serve as the point of attachment to a backside of a loop or hook fastener (720 of FIG. 7). In embodiments that do not include a base member 710, the flexibility of removable work surface attachment 700 may be maximized, improving flexibility and tactile feel. One of ordinary skill in the art will recognize that the composition of removable work surface attachment 700 may vary based on an application or design in accordance with one or more embodiments of the present invention.

Figure 9:
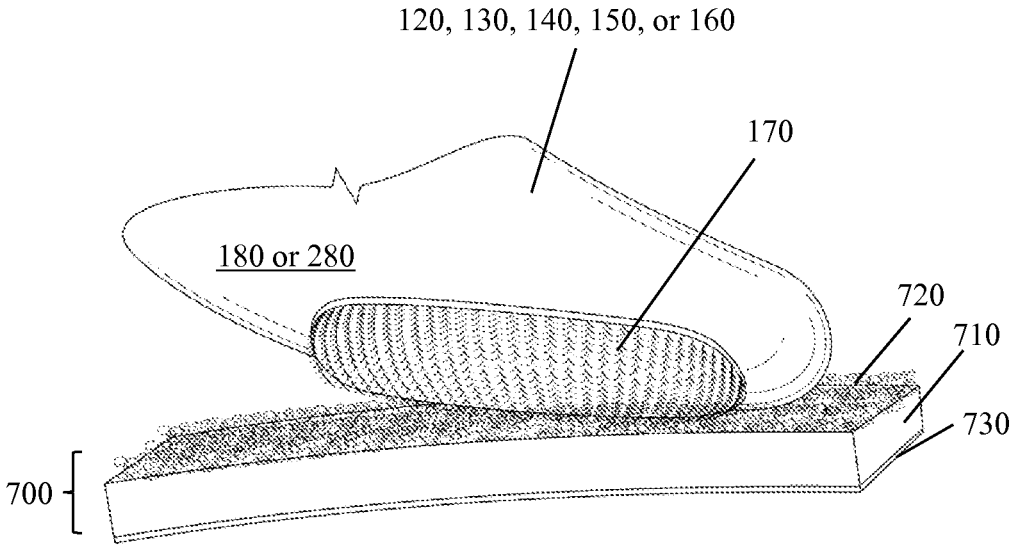
FIG. 9 shows the attachment of a removable work surface attachment to a distal phalanx portion of a finger sheath or thumb sheath of a high articulation glove in accordance with one or more embodiments of the present invention.

FIG. 9 shows the attachment of a removable work surface attachment 700 to a distal phalanx portion 180 or 280 of a finger sheath 130, 140, 150, or 160 or a thumb sheath 120 of a high articulation glove (not independently illustrated) in accordance with one or more embodiments of the present invention. A high articulation glove (e.g., 100 of FIG. 1) allows a worker to wear the glove throughout the performance of a task or series of tasks. Because of high articulation and flexibility, the worker can perform tasks that require the dexterous use of the fingers and hand in general. When a task or series of tasks requires a work surface 730, the worker may removably attach one or more removable work surface attachments 700 without having to remove the glove. When a task or series of tasks does not require it, the worker may remove one or more removable work surface attachments 700, also without having to remove the glove. As a consequence, the worker may wear the glove continuously throughout the performance of their work.

A hook or loop fastener 170 of a finger sheath 130, 140, 150, or 160 or a thumb sheath 120 of a covering (105 of FIG. 1 and FIG. 2) may mate with a loop or hook fastener 720 of a removable work surface attachment 700. With minimal force, the wearer of a high articulation glove may press hook or loop fastener 170 onto a complimentary loop or hook fastener 720 of a removable work surface attachment 700, thereby joining them together. The various hooks and loops join together when they come into contact with one another. The strength of the bond depends, in substantial part, on the size of the area of contact between hook or loop fastener 170 of the glove and loop or hook fastener 720 of the removable work surface attachment 700 and the pressure applied in joining them together. Because hook or loop fastener 170 is constrained to a size smaller than the distal phalanx portion 180 or 280, a sufficiently strong bond is made to allow for the use of removable work surface attachment 700, but also allow for easy removal of removable work surface attachment 700 with, for example, the other hand, without having to take off the glove.

Figure 10:
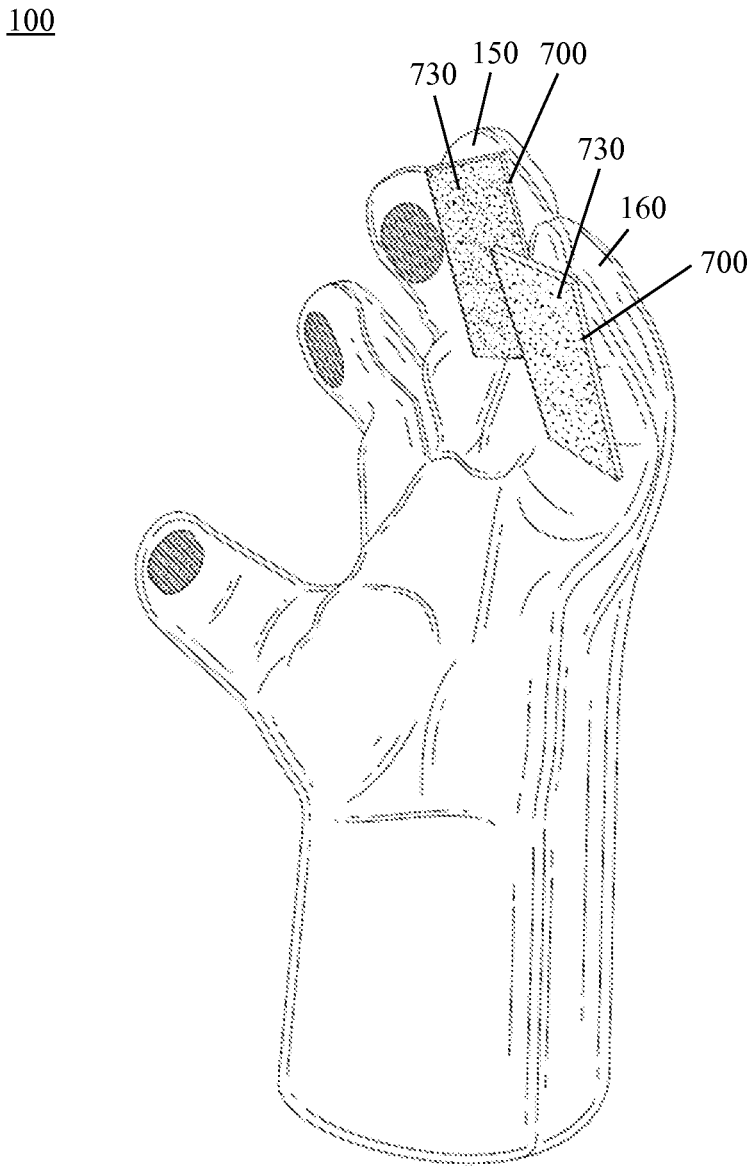
FIG. 10 shows a plurality of removable work surface attachments attached to a palm side of a high articulation glove in accordance with one or more embodiments of the present invention.

FIG. 10 shows a plurality of removable work surface attachments 700 attached to a palm side of a high articulation glove 100 in accordance with one or more embodiments of the present invention. In certain applications, a worker may wish to attach a plurality of removable work surface attachments 700 to high articulation glove 100. For example, in certain embodiments, the attachment of a plurality of removable work surface attachments 700 to high articulation glove 100 may allow the wearer of glove 100 to work with a plurality of surfaces, angles, and/or corners of the same, or even a different, object (not shown) in an ergonomic manner. Because grip is not required, hand fatigue is minimized allowing the worker to work longer, more efficiently, and more effectively. In addition, because of the location of removable work surface attachments 700, the worker may maintain tactile feel in areas of glove 100 where the removable work surface attachments 700 are not attached. In these applications, the worker may be able to work with various surfaces, angles, and/or corners of the object or objects at the same time in a precise manner. In other embodiments, the attachment of a plurality of removable work surface attachments 700 may allow the wearer of glove 100 to use different types of work surfaces 730 at the same time in an ergonomic manner. In these applications, the worker may, for example, use a first sanding surface of a first grit and a second sanding surface of a second grit on one or more surfaces, angles, and/or corners of an object or objects at the same time. The choice of which fingers or thumb sheaths are used may be dictated by the ergonomics of the interaction between the removable work surface attachments 700 and the object or objects being worked on. One of ordinary skill in the art will recognize that a number, size, shape, and kind of removable work surface attachments 700 used may vary based on an application or design in accordance with one or more embodiments of the present invention.

Figure 11:
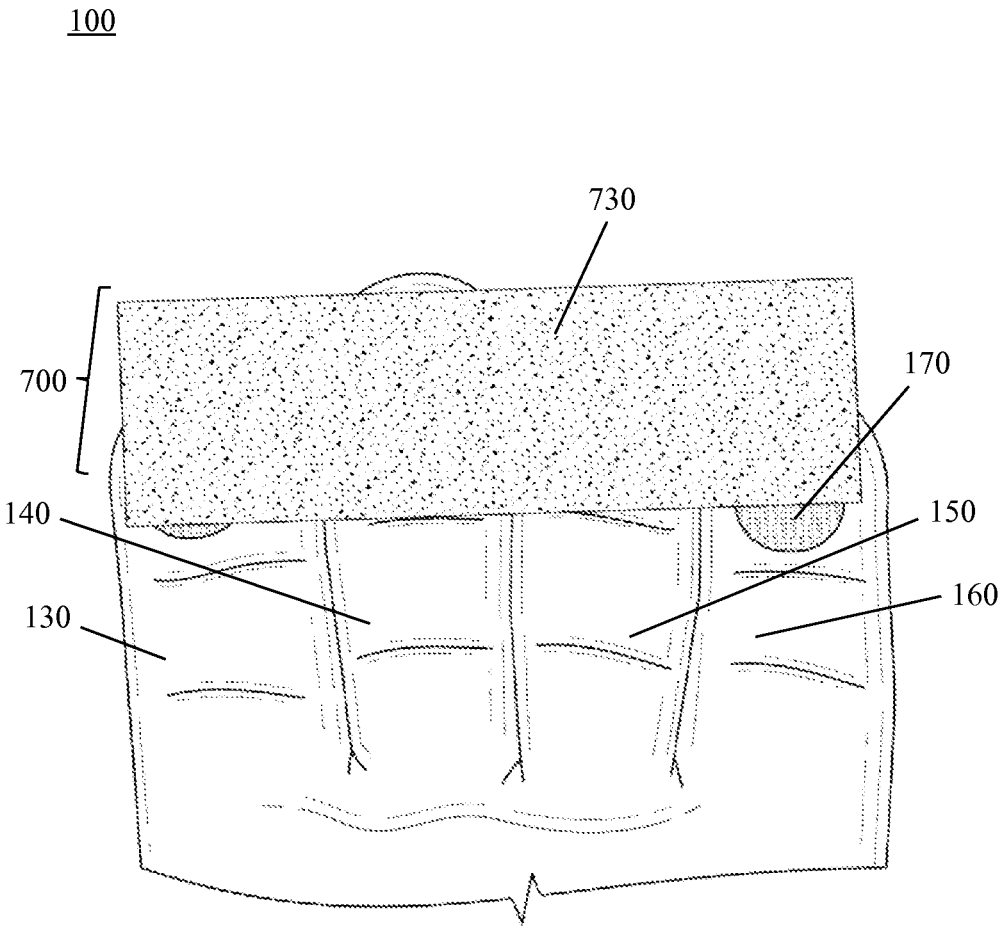
FIG. 11 shows a removable work surface attachment attached to a plurality of finger sheaths of a high articulation glove in accordance with one or more embodiments of the present invention.

FIG. 11 shows a removable work surface attachment 700 attached to a plurality of finger sheaths 130, 140, 150, and 160 of a high articulation glove 100 in accordance with one or more embodiments of the present invention. In certain embodiments, a removable work surface attachment 700 may have a size and a shape that allows for the attachment of removable work surface attachment 700 to a plurality of finger sheaths 130, 140, 150, and/or 160 and their corresponding hook or loop fasteners 170. This may be desirable in applications where, for example, a stronger bond between removable work surface attachment 700 and high articulation glove 100 is desired or a larger work surface 730 coverage is desired. Because grip is not required, hand fatigue is minimized allowing the worker to work longer, more efficiently, and more effectively. In addition, because of the location of removable work surface attachment 700, the worker may maintain tactile feel in areas of glove 100 where the removable work surface attachments 700 are not attached. One of ordinary skill in the art will recognize the number of finger sheaths 130, 140, 150, and/or 160 in the plurality of finger sheaths used for attachment may vary based on an application or design. One of ordinary skill in the art will recognize that a thumb sheath (not shown) may be used with one or more of the finger sheaths 130, 140, 150, and/or 160 in one or more embodiments of the present invention.

Figure 12:
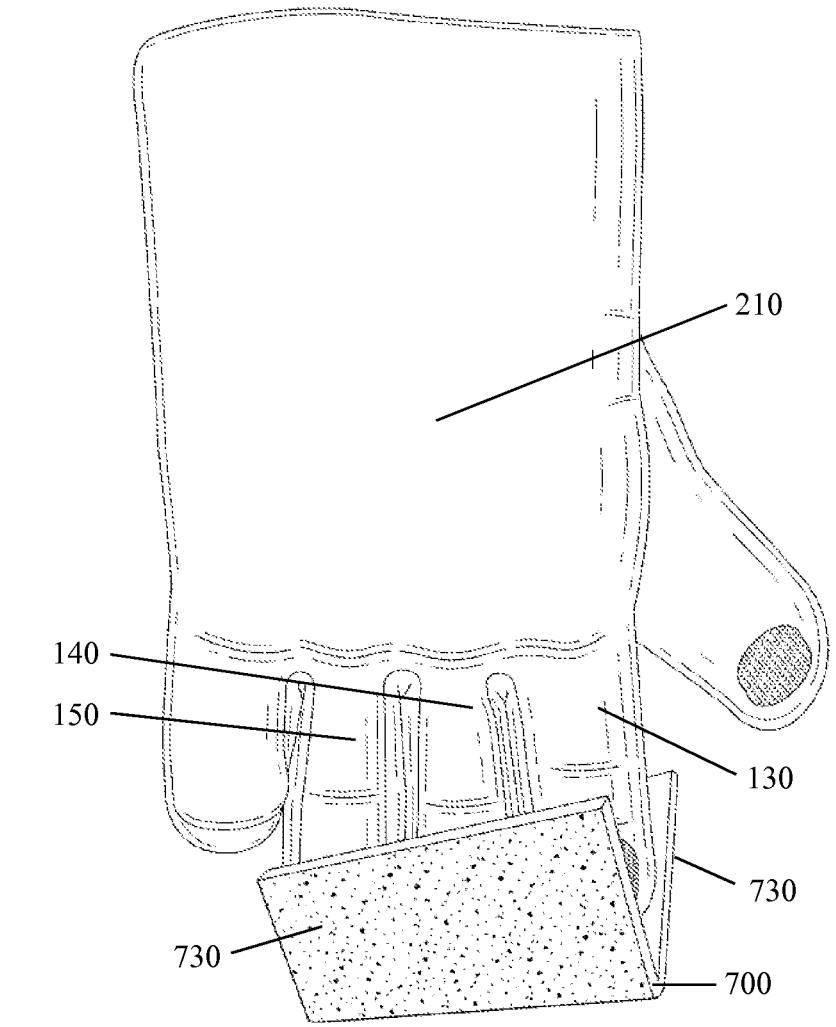
FIG. 12 shows a removable work surface attachment attached to a palm side and a dorsal side of a high articulation glove in accordance with one or more embodiments of the present invention.

FIG. 12 shows a removable work surface attachment 700 attached to a palm side and a dorsal side of a high articulation glove 100 in accordance with one or more embodiments of the present invention. In certain embodiments, a removable work surface attachment 700 may have a size and a shape that allows for the attachment of removable work surface attachment 700 to one or more hook or loop fasteners 170 on a palm side of high articulation glove 100 and to one or more hook or loop fasteners on a dorsal side of high articulation glove 100 at the same time. In some applications, where, for example, there is a desire to work two surfaces of a narrow crevice, removable work surface attachment 700 may attach to one or more hook or loop fasteners 170 on a palm side of high articulation glove 100 and to one or more hook or loop fasteners 170 on a dorsal side of high articulation glove 100 at the same time allowing the worker to work multiple surfaces simultaneously. In addition, because of the high articulation and the flexibility of the gloved hand, the worker may be able to curve work surfaces 730 to the surface they are working and allows the worker to work angled or curved surfaces that would otherwise not be possible. This promotes ergonomic motion capable of adapting to the angle or curvature of a surface, does not require grip that fatigues the hand, and allows the worker to work longer, more efficiently, and more effectively. In addition, the worker may maintain tactile feel in areas of glove 100 where the removable work surface attachment 700 is not attached.

Figure 13:
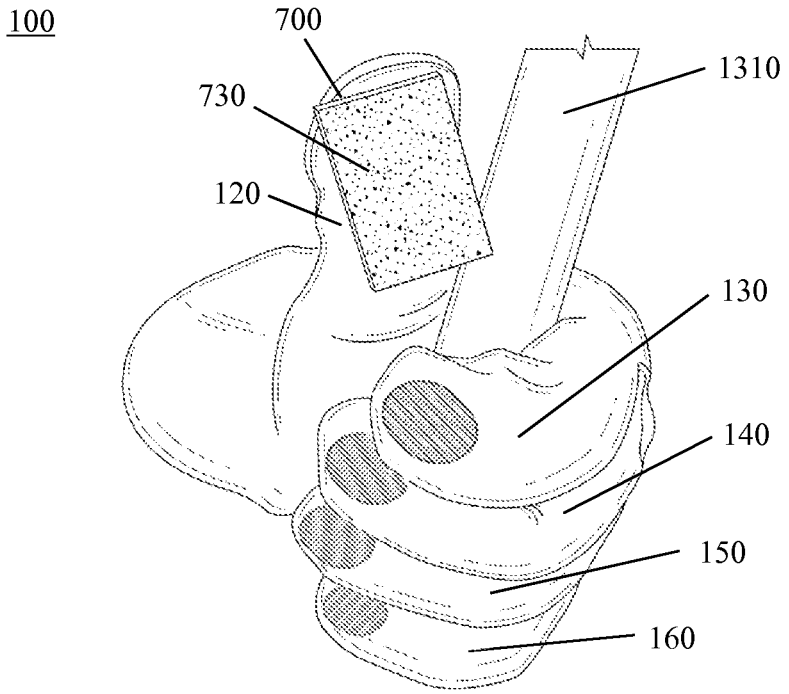
FIG. 13 shows a high articulation glove with an attached removable work surface attachment grasping an object in accordance with one or more embodiments of the present invention.

FIG. 13 shows a high articulation glove 100 with an attached removable work surface attachment 700 grasping an object 1310 in accordance with one or more embodiments of the present invention. Because of the location of removable work surface attachment 700, a worker may maintain tactile feel in areas of glove 100 where the removable work surface attachments 700 are not attached and use those portions to grasp one or more objects. For example, the worker may grasp an object 1310 while one or more removable work surface attachments 700 are attached to high articulation glove 100. Advantageously, a worker may attach or remove one or more removable work surface attachments 700 as needed, while retaining the dexterous use of the gloved hand, including the ability of the gloved hand to articulate, grasp objects, and maintain tactile feel. In certain embodiments, where, for example, object 1310 is a tool or implement, one or more loop or hook fasteners (not shown) may be disposed on the tool or implement such that the tool or implement may be secured to the at least one hook or loop fasteners disposed on the distal phalanx portion (180 of FIG. 1) of one or more of the finger sheaths 130, 140, 150, or 160 on the palm side of glove 100.

Figure 14:
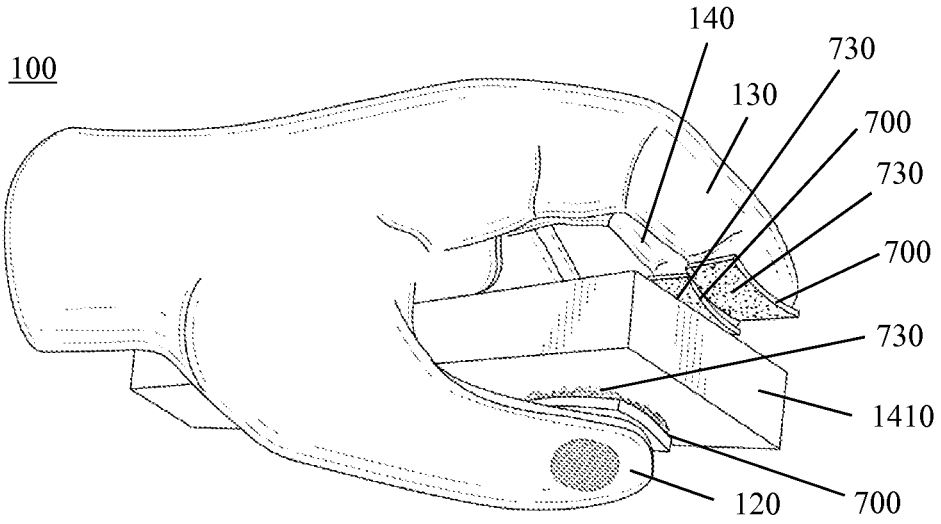
FIG. 14 shows a high articulation glove with a plurality of attached removable work surface attachments working multiple surfaces of an object simultaneously in accordance with one or more embodiments of the present invention.

FIG. 14 shows a high articulation glove 100 with a plurality of attached removable work surface attachments 700 working multiple surfaces of an object 1410 simultaneously in accordance with one or more embodiments of the present invention. Because of the location of removable work surface attachment 700, a worker may maintain tactile feel in areas of glove 100 where the removable work surface attachments 700 are not attached and use those portions to grasp one or more objects. For example, the worker may grasp an object 1410 while simultaneously working a plurality of surfaces of object 1410. Advantageously, a worker may attach one or more removable work surface attachments 700 to work a first surface of object 1410 and also attach one or more removable work surface attachments 700 to work a second surface of object 1410 at the same time. The worker retains the dexterous use of the gloved hand, including the ability of the gloved hand to articulate and grasp one or more tools, implements, or objects with precision while working a plurality of surfaces.

Advantages of one or more embodiments of the present invention may include one or more of the following:

In one or more embodiments of the present invention, a high articulation glove may be used in the performance of a task or series of tasks without requiring the putting on or taking off of the glove or the use of multiple gloves.

In one or more embodiments of the present invention, a high articulation glove is a multi-purpose glove that compliments the precision of the hand and the diversity of hand movement in a manner than does not inhibit the range of motion over a conventional glove made of the same material.

In one or more embodiments of the present invention, a high articulation flexible glove maximizes control of the gloved hand and provides for ergonomic grip.

In one or more embodiments of the present invention, a high articulation glove protects the gloved hand and allows for the dexterous use of the gloved hand in the performance of a task or a series of tasks without having to remove the glove.

In one or more embodiments of the present invention, a high articulation glove protects the gloved hand and allows for the dexterous use of the gloved hand while working on or with one or more objects including one or more surfaces, angles, and/or corners.

In one or more embodiments of the present invention, a high articulation glove allows for the articulation of the distal interphalangeal joints, the proximal interphalangeal joints, the metacarpophalangeal joints, and the bony arches of the gloved hand.

In one or more embodiments of the present invention, a high articulation glove includes at least one hook or loop fastener attached to a distal phalanx portion of at least one of the finger sheaths on a palm side of a covering of the glove. Because the hook or loop fasteners are not disposed elsewhere on the palm side of the covering, the gloved hand may articulate and retain tactile feel. In addition, the disposition of the at least one hook or loop fastener prolongs the usable life of the hook or loop fasteners because they are not disposed in the palm area where constant contact or grip would deform the hooks or loops of the fastener.

In one or more embodiments of the present invention, a high articulation glove optionally includes a hook or loop fastener attached to a distal phalanx portion of a thumb sheath on a palm side of a covering of the glove.

In one or more embodiments of the present invention, a high articulation glove optionally includes at least one hook or loop fastener attached to a distal phalanx portion of at least one of the finger sheaths on a dorsal side of the covering. Because the hook or loop fasteners are not disposed elsewhere on the dorsal side of the covering, the gloved hand may articulate and retain tactile feel.

In one or more embodiments of the present invention, a high articulation glove optionally includes a hook or loop fastener attached to a distal phalanx portion of a thumb sheath on a dorsal side of a covering of the glove.

In one or more embodiments of the present invention, a high articulation glove includes at least one hook or loop fastener sized smaller than a distal phalanx portion of at least one of the finger sheaths such that the hook or loop fastener attaches easily to a loop or hook fastener disposed on one or more removable work surface attachments. Because of the footprint of the fastened hooks and loops, removable work surface attachments may be easily attached and removed. As the area of the fastened hooks and loops increases, it becomes increasingly difficult to remove the one or more removable work surface attachments. By limiting the size of the hook or loop fastener disposed on the glove, the one or more removable work surface attachments may be easily attached and removed without necessitating removal of the glove.

In one or more embodiments of the present invention, a high articulation glove protects the gloved hand and allows for the dexterous use of one or more of the gloved fingers, with or without one or more removable work surface attachments, while working on or with one or more objects including one or more surfaces, angles, and/or corners. The gloved hand and fingers retain their tactile feel allowing for precision in the performance of work.

In one or more embodiments of the present invention, a high articulation glove may integrate the function of one or more tools or work surfaces into the glove by way of one or more removable work surface attachments. The one or more attached removable work surface attachments function as an integrated part of the glove allowing for the dexterous use of the one or more removable work surface attachments.

In one or more embodiments of the present invention, a high articulation glove allows for the ergonomic use of one or more removable work surface attachments that promote the natural motion of the gloved hand and/or the gloved fingers in a manner that does not require constant grip that would otherwise be required to hold a discrete tool, implement, or work surface. Constant grip is well known to fatigue the hand and cause injury. Because of the ergonomic design, the wearer of the glove may be able to work longer, more efficiently, and more effectively free from fatigue, stress, and/or injury.

In one or more embodiments of the present invention, a high articulation glove allows for the more efficient use of work surface resources. A problem commonly experienced when, for example, sanding by hand, or even using commercially available hand sanding tools, such as sanding blocks, is that, because of their design, a portion of the sanding paper is never used while other parts are overused. In addition, pressure required to sand an object often results in uneven wear of the sandpaper and premature failure. The removable work surface attachment with a rigid base distributes finger pressure across the attachment and sandpaper, allowing even wear.

In one or more embodiments of the present invention, a high articulation glove may use a plurality of removable work surface attachments of a different type or kind at the same time while working on or with one or more objects including one or more surfaces, angles, and/or corners. For example, a removable sand paper attachment with a first grit may be used with another removable sand paper attachment with a second grit at the same time. The number of removable work surface attachments used may vary based on the need of a particular application or design.

In one or more embodiments of the present invention, a high articulation glove allows a wearer of the glove to perform a variety of dexterous tasks, including those tasks that require a glove for protection as well as those that do not, without having to put on or take off the glove. The wearer of the glove may make more efficient use of time and does not have to interrupt the performance of a task or series of tasks to put on or take off the glove which may be cumbersome or even difficult depending on the circumstances. They may simply wear the high articulation glove continuously.

In one or more embodiments of the present invention, a high articulation glove allows a wearer of the glove to perform a variety of dexterous tasks, including those tasks that require one or more removable work surface attachments as well as those that do not, without having to put on or take off the glove. One or more removable work surface attachments may be secured to the glove when needed and removed when their use is not desired.

In one or more embodiments of the present invention, a high articulation flexible glove allows for the dexterous use of a hand and/or one or more fingers while working on or with one or more objects including one or more surfaces, angles, and/or corners.

In one or more embodiments of the present invention, a high articulation glove may be worn on one or both hands at the same time.

In one or more embodiments of the present invention, a high articulation glove allows for the dexterous use of one or more removable work surface attachments including, for example, cleaning, scouring, sanding, and/or polishing attachments. The removable work surface attachments may vary in shape, size, and kind. The removable work surface attachments may vary in rigidity.

In one or more embodiments of the present invention, a high articulation glove allows for the dexterous use of the gloved hand to hold or grip one or more tools, implements, and/or objects.

In one or more embodiments of the present invention, a high articulation glove allows for the dexterous use of one or more removable work surface attachments while also holding or gripping one or more tools, implements, and/or objects.

In one or more embodiments of the present invention, a high articulation glove may be flexible allowing for the individual use of the gloved fingers and thumb. The removable work surface attachment may attach to a portion of a finger sheath or thumb sheath of the glove corresponding to a distal phalanx portion.

In one or more embodiments of the present invention, a high articulation glove allows for the dexterous use of a palm of the gloved hand and one or more of a distal phalange, an intermediate phalange, and a proximal phalange of one or more of the gloved fingers while working on or with one or more objects including one or more surfaces, angles, and/or corners.

In one or more embodiments of the present invention, a high articulation glove allows for the dexterous use of one or more of a distal phalange, an intermediate phalange, and a proximal phalange of one or more of the gloved fingers while working on or with one or more objects including one or more surfaces, angles, and/or corners.

In one or more embodiments of the present invention, a high articulation glove allows for the dexterous use of one or more of a distal phalange and an intermediate phalange of one or more of the gloved fingers while working on or with one or more objects including one or more surfaces, angles, and/or corners.

In one or more embodiments of the present invention, a high articulation glove may be flexible allowing for the dexterous use of a distal phalanx of one or more of the gloved fingers.

In one or more embodiments of the present invention, a high articulation glove may be flexible allowing for the dexterous use of an intermediate phalanx of one or more of the gloved fingers.

In one or more embodiments of the present invention, a high articulation glove may reduce the risk of injury from using powered tools, discrete tools, or implements.

In one or more embodiments of the present invention, a high articulation glove may reduce the risk of injury occasioned by the use of the wrong glove for a given task that is prone to misalignment, slipped grip, and drops.

In one or more embodiments of the present invention, a high articulation glove is convenient and easy to use.

In one or more embodiments of the present invention, a high articulation glove may be put on or taken off by attaching or removing the at least one hook or loop fasteners disposed on the glove to a loop or hook fastener secured to, for example, a work bench or a cabinet door. The worker may join the glove to the bench or the cabinet door to secure it in place and remove the glove with ease. Similarly, the worker may put the glove on in the same manner. In certain embodiments, the use of at least one hook or loop fasteners disposed on the distal phalanx portions of the finger sheaths on the dorsal side of the glove may be used for this purpose so as to not wear out or otherwise interfere with the at least one hook or loop fasteners disposed on the distal phalanx portions of the finger sheaths on the palm side of the glove.

In one or more embodiments of the present invention, a high articulation glove does not require expertise. Certain types of tools, such as, for example, a powered sander and a powered polisher, require some measure of expertise to use. For workers who do not routinely work with such tools, they may damage materials as well as the tools themselves. Instead, a worker may attach a removable work surface attachment that allows the worker to perform the same task as, for example, the power sander or the polisher. Because of the high articulation and the flexibility of a high articulation glove, the worker may use the removable work surface attachment in an ergonomic manner that does not fatigue the hand. As such, the high articulation glove provides an inexpensive, convenient, and easy to use alternative to other types of tools.

In one or more embodiments of the present invention, a high articulation glove ergonomically integrates the function of one or more powered tools, discrete tools, or implements into the glove.

In one or more embodiments of the present invention, a high articulation glove may use one or more discrete tools in place of, or in combination with, one or more removable work surface attachments. A loop or hook fastener may be disposed on the one or more discrete tools. A tool may be secured in place by joining a loop or hook fastener of the tool with one or more of the hook or loop fasteners of the glove. As such, a tool may be secured in place during use, preventing slippage and drops.

In one or more embodiments of the present invention, a high articulation glove allows for the use of the function of one or more powered tools, discrete tools, or implements in applications or designs that are difficult to use with powered tools, discrete tools, or implements.

In one or more embodiments of the present invention, a high articulation glove allows for the use of the function of one or more powered tools, discrete tools, or implements in applications or designs that, for whatever reason, cannot use them.

In one or more embodiments of the present invention, a high articulation glove allows for prolonged use of the glove and one or more removable work surface attachments in an ergonomic manner that prevents fatigue.

In one or more embodiments of the present invention, a high articulation glove is simple and inexpensive to manufacture.

In one or more embodiments of the present invention, an existing glove may be modified by attaching at least one hook or loop fastener to a distal phalanx portion of one of the finger sheaths on the palm side of the glove and optionally attaching a hook or loop fastener to a distal phalanx portion of the thumb sheath on the palm side. In this way, an existing glove may be leveraged to reduce production time and manufacturing complexity.

In one or more embodiments of the present invention, an existing glove may be modified by attaching at least one hook or loop fastener to a distal phalanx portion of one of the finger sheaths on the dorsal side of the glove and optionally attaching a hook or loop fastener to a distal phalanx portion of the thumb sheath on the dorsal side. In this way, an existing glove may be leveraged to reduce production time and manufacturing complexity.

In one or more embodiments of the present invention, a high articulation glove is less expensive than other solutions that produce the same result.

In one or more embodiments of the present invention, one or more finger cots may be used in place of a high articulation flexible glove. A finger cot is a finger sheath that covers some or all of a given finger. The finger cot may be comprised of natural or synthetic fabrics, rubber, nitrile, plastic material, elastomeric material, or combinations thereof. A hook or loop fastener may be attached to, or integrated into, a distal phalanx portion of the finger cot on a palm side or a dorsal side. A loop or hook fastener of a removable work surface attachment may be used to removably attach the removable work surface attachment to the hook or loop fastener attached to, or integrated into, the finger cot. In this way, one or more finger cots may be used instead of a high articulation flexible glove in applications or designs that do not require, or benefit from, a full glove. Advantageously, one or more finger cots allows for the use of a removable work surface attachment with minimal encumbrance of the hand.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A high articulation glove comprising:

a covering for a human hand comprising a palm portion, a dorsal portion, a thumb sheath, an index finger sheath, a middle finger sheath, a ring finger sheath, and a small finger sheath;

a first hook or loop fastener attached to a distal phalanx portion of one of the index finger sheath, the middle finger sheath, the ring finger sheath, or small finger sheath on a palm side of the covering;

a second hook or loop fastener attached to a distal phalanx portion of a different finger sheath than the first hook or loop fastener, on the palm side of the covering; and a removable work surface attachment comprising a work surface disposed on a first side of the attachment and a loop or hook fastener disposed on a second side of the attachment, wherein each of the hook or loop fasteners have a size smaller than the distal phalanx portion of the corresponding finger sheath it is attached to, wherein there are no hook or loop fasteners disposed elsewhere on the palm side of the covering, and wherein the work surface comprises at least one of a sanding surface, a polishing surface, a scouring surface, or a cleaning surface.

2. The high articulation glove of claim 1, further comprising:

a third hook or loop fastener attached to a distal phalanx portion of one of the index finger sheath, the middle finger sheath, the ring finger sheath, or the small finger sheath on a dorsal side of the covering; and a fourth hook or loop fastener attached to a distal phalanx portion of a different finger sheath than the third hook or loop fastener, on the dorsal side of the covering.

3. The high articulation glove of claim 1, wherein the hook or loop fasteners are integrated into the covering during manufacture.

4. The high articulation glove of claim 1, wherein the hook or loop fasteners are attached to the finger sheaths on the palm side of the covering by an adhesive.

5. The high articulation glove of claim 1, wherein the hook or loop fasteners are attached to the finger sheaths on the palm side of the covering by stitching.

6. The high articulation glove of claim 1, wherein the hook or loop fasteners have a substantially oval shape.

7. The high articulation glove of claim 1, wherein the covering is comprised of a material that allows a plurality of distal interphalangeal joints, a plurality of proximal interphalangeal joints, a plurality of metacarpophalangeal joints, and a plurality of bony arches of the hand to articulate when wearing the glove.

8. A high articulation glove comprising:

a covering for a human hand comprising a palm portion, a dorsal portion, a thumb sheath, an index finger sheath, a middle finger sheath, a ring finger sheath, and a small finger sheath;

a first hook or loop fastener attached to a distal phalanx portion of one of the index finger sheath, the middle finger sheath, the ring finger sheath, or small finger sheath on a palm side of the covering; and a removable work surface attachment comprising a work surface disposed on a first side of the attachment and a loop or hook fastener disposed on a second side of the attachment, wherein each of the hook or loop fasteners have a size smaller than the distal phalanx portion of the corresponding finger sheath it is attached to, wherein there are no hook or loop fasteners disposed elsewhere on the palm side of the covering, and wherein the work surface comprises at least one of a sanding surface, a polishing surface, a scouring surface, or a cleaning surface.

9. The high articulation glove of claim 8, further comprising:

a second hook or loop fastener attached to a distal phalanx portion of one of the index finger sheath, the middle finger sheath, the ring finger sheath, or the small finger sheath on a dorsal side of the covering.

10. The high articulation glove of claim 8, wherein the covering is comprised of a material that allows a plurality of distal interphalangeal joints, a plurality of proximal interphalangeal joints, a plurality of metacarpophalangeal joints, and a plurality of bony arches of the hand to articulate when wearing the glove.

11. The high articulation glove of claim 8, wherein the hook or loop fastener is integrated into the covering during manufacture.

12. The high articulation glove of claim 8, wherein the hook or loop fastener is attached to the finger sheath on the palm side of the covering by an adhesive.

13. The high articulation glove of claim 8, wherein the hook or loop fastener is attached to the finger sheath on the palm side of the covering by stitching.

14. The high articulation glove of claim 8, wherein the hook or loop fastener has a substantially oval shape.

* * * * *